United States Patent [19]

Bennett

[11] Patent Number: 4,611,210

[45] Date of Patent: Sep. 9, 1986

[54] TURNAROUND CONTROL FOR MECHANICALLY SCANNED RADAR ANTENNAS

[75] Inventor: R. James Bennett, Laurel, Md.

[73] Assignee: The United States of America as represented by the Secretary of the Air Force, Washington, D.C.

[21] Appl. No.: 622,614

[22] Filed: Jun. 20, 1984

[51] Int. Cl.[4] ..... H01Q 3/02

[52] U.S. Cl. ..... 343/359; 343/5 ST

[58] Field of Search ..... 318/144, 567–569; 343/5 ST, 6 ND, 7 A, 7.4, 16 M, 757, 760, 359; 364/423, 807–810, 816, 836, 860

[56] References Cited

U.S. PATENT DOCUMENTS

| | | | |
|---|---|---|---|
| 2,515,248 | 7/1950 | McCoy | 318/144 |
| 2,704,815 | 3/1955 | Guiles | 307/149 |
| 2,926,348 | 2/1960 | Asquith | 343/7.4 |
| 3,078,455 | 2/1963 | Brainin | 343/7 A |
| 3,091,761 | 5/1963 | Gebhardt | 343/7.4 |
| 4,084,159 | 4/1978 | Anderson et al. | 343/7.4 |

OTHER PUBLICATIONS

*Introduction to Radar Systems;* by M. I. Skolnik; McGraw-Hill (N.Y., 1970); pp. 177–178.

"A High Performance Microprocessor-Based Digital Controller", by D. Chenoweth et al.; Asilomar Conference (Nov. 7–9, 1977; Pacific Grove, Calif.).

*Primary Examiner*—Thomas H. Tarcza
*Assistant Examiner*—Bernarr Earl Gregory
*Attorney, Agent, or Firm*—Donald J. Singer; Bernard E. Franz

[57] ABSTRACT

A programmed turnaround generator for a mechanically scanned antenna, to provide an n-bar scan pattern (n may be 1), with predetermined inputs to the generator comprising a desired turnaround time, a maximum excursion of the antenna in azimuth, and a start position for each bar, is mechanized using closed form equations such as:

$$AZ_t = C_1 - C_2 \cdot (t')^2$$

$$EL_t = C_3 + C_4 \cdot t' \cdot (|t'| - C_5)$$

where t' is a function of a real time clock, $C_1$ is the azimuth position at the middle of the turnaround. $C_2$ is a multiplier for azimuth. $C_3$ is the elevation position at the middle of the turnaround. $C_4$ is an elevation multiplier, and $C_5$ is the desired time of offbar or turnaround time.

2 Claims, 4 Drawing Figures

PROJECTION OF ANTENNA
UNIT VECTOR T = 1.005

ERROR SIGNALS

TURNAROUND CONTROL FOR MECHANICALLY SCANNED RADAR ANTENNAS

RIGHTS OF THE GOVERNMENT

The invention described herein may be manufactured and used by or for the Government of the United States for all governmental purposes without the payment of any royalty.

BACKGROUND OF THE INVENTION

This invention relates to turnaround control for mechanically scanned radar antennas.

"A tracking radar must first find and acquire its target before it can operate as a tracker. Therefore it is usually necessary for the radar to scan an angular section in which the presence of the target is suspected. Most tracking radars employ a narrow pencil-beam antenna. Searching a volume in space for an aircraft target with a narrow pencil beam would be somewhat analogous to searching for a fly in a darkened auditorium with a flashlight. It must be done with some care if the entire volume is to be covered uniformly and efficiently." (M. I. Skolnik, "Introduction to Radar Systems" Second Edition, 1980. McGraw Hill Book Co., page 177). Examples of scanning patterns are shown by Skolnik on page 178. The raster scan is a simple and convenient means for searching a limited sector, rectangular in shape, in a uniform manner. It is also called an n-bar scan, where n is the number of horizontal rows. "Onbar" is a period during which the elevation remains fixed while the azimuth varies from one end of a bar to the other end. During an offbar or turnaround period the elevation changes from one bar to another, preferably in a smooth curve in which the azimuth continues to change out to a limit and then returns to the beginning of the next bar.

Antenna pickoffs are used in many systems to provide an accurate determination of antenna position. However they are expensive and are therefore omitted in some cost-sensitive systems. In the latter systems, the antenna turnaround mechanization may be a source of degraded system performance and reduced system flexibility. A turnaround must be at the end of each bar in a scan pattern, which introduces error transients into the true antenna pointing vector, and they extend into the "onbar" period. The two factors which have most impeded a solution to this problem are (1) requirements for frequent, variable length, system calibrations, and (2) the lack of antenna pickoffs for accurate determination of antenna position.

One previous system filters a scan rate reversal and them integrates to generate a smooth turn. To minimize transients, this filter runs during "onbar" also, producting a slowed scan rate and increased frame time. The scan generated vector is used as the true vector, which results in errors as large as 0.5–0.7 degree, during onbar. Much larger errors exist during the turn, thus, this time is used for calibrations ands tests instead of radar data collection. This "blind time" is reduced by setting the scan filter coefficients to generate a constant 200-millisecond turn. In those cases in which the calibration does not finish, the control software attempts to stop the antenna, introducing worse transients in the onbar period.

Other previous systems did not have requirements for frequent calibrations and did have antenna pickoffs. Two of these systems did generate the turnaround by an integrated, filtered, scan rate reversal and did not perform standard data collection during the turn period. In another of these systems, the turn was generated in an open loop manner using an AZ-EL independent rate-/acceleration limiter to smooth an instaneous jump to the start of the next bar. This technique generates a *constant* turn period, with no control of excursion, but the correct onbar scan rate was achieved.

In previous systems, the antenna was controlled by rate only, and not by position. The control was by error signals. There was no actual control of the path. The error signals gave no useful indication of the antenna position. There was a serious problem with gimbal limits.

SUMMARY OF THE INVENTION

An object of the invention is to solve the problem of degraded system performance from antenna pointing error transients induced by the antenna turnaround mechanization and to eliminate an automatic "blind" period at turnaround without requiring antenna pickoffs. Another object is to provide increased flexibility and a mechanization to improve accuracy for any cost-sensitive system which does not have antenna pickoffs and requires frequent calibrations.

According to the invention, a programmable turnaround generator is employed to smooth the antenna pointing error signals for closed loop correction of the generated pointing vector. Inputs to the generator include (1) the desired turnaround time, (2) the maximum excursion and (3) the start position of the next bar. One mechanization of this generator was specially formulated to reduce logic and arithmetic requirements. It uses closed form AZ-EL position equations based on constant acceleration/deceleration.

Novel features of this turnaround generator include: (1) Closed loop correction of pointing vector. (2) Control of antenna maximum excursion. (3) Programmable turnaround time. (4) Elimination of automatic "blind" turn period. (5) Elimination of command vector drift.

More specifically, the points of novelty provide:

1. The resulting error signals are well behaved and allow closed loop correction of the pointing vector without sacrificing frame time or onbar scan rate. As a result, system performance is increased during onbar *without* the requirement of antenna pickoffs.

2. A closed form equation mechanization of the turnaround allows control of the generated excursion for the antenna. Closed form means that the commanded antenna position, rate and acceleration can be explicity stated as a function of time (as opposed to integrating an unknown function of time—like rate, subject to error limits and completion of some calibration, to determine incremental changes to position, rate and acceleration.)

3. Flexibility for system requirements is increased by the introduction of the desired turnaround time into the turn mechanization and system performance is increased by elimination of variable turn time induced transients.

4. The turn time can be used for active data collection, instead of blind time, without the requirement of antenna pickoffs. This feature is attractive for modes of short duration (where calibrations can be delayed) or for modes with short scan bars, such as Spotlight Search, a 4-bar reacquisition mode or even ACM (Air Combat Mode) search.

5. The closed form equations for position eliminate the possibility of drift from arithmetic inaccuracy and falling behind due to filtering a rate as previous mechanizations. This is the first time that this capability has been mechanized and is very important for modes such as track while scan (TWS) and for system performance analysis.

The turnaround generator according to the invention is not a fixed parameter system; but is able to dynamically adjust parameters of the turnaround equations dependent on exterior conditions at the time.

As distinquished from prior systems, limited by error signals with control by rate only and not by position; the present turnaround generator controls both the path positon and the rate with constant acceleration. The rate was made to match the mechanical behavior of the antenna.

The ability for active data collection during turnaround is particularly important for short bars, such as 10°. It also helps overcome problems with gimbal limits.

DETAILED DESCRIPTION

Figure 1:
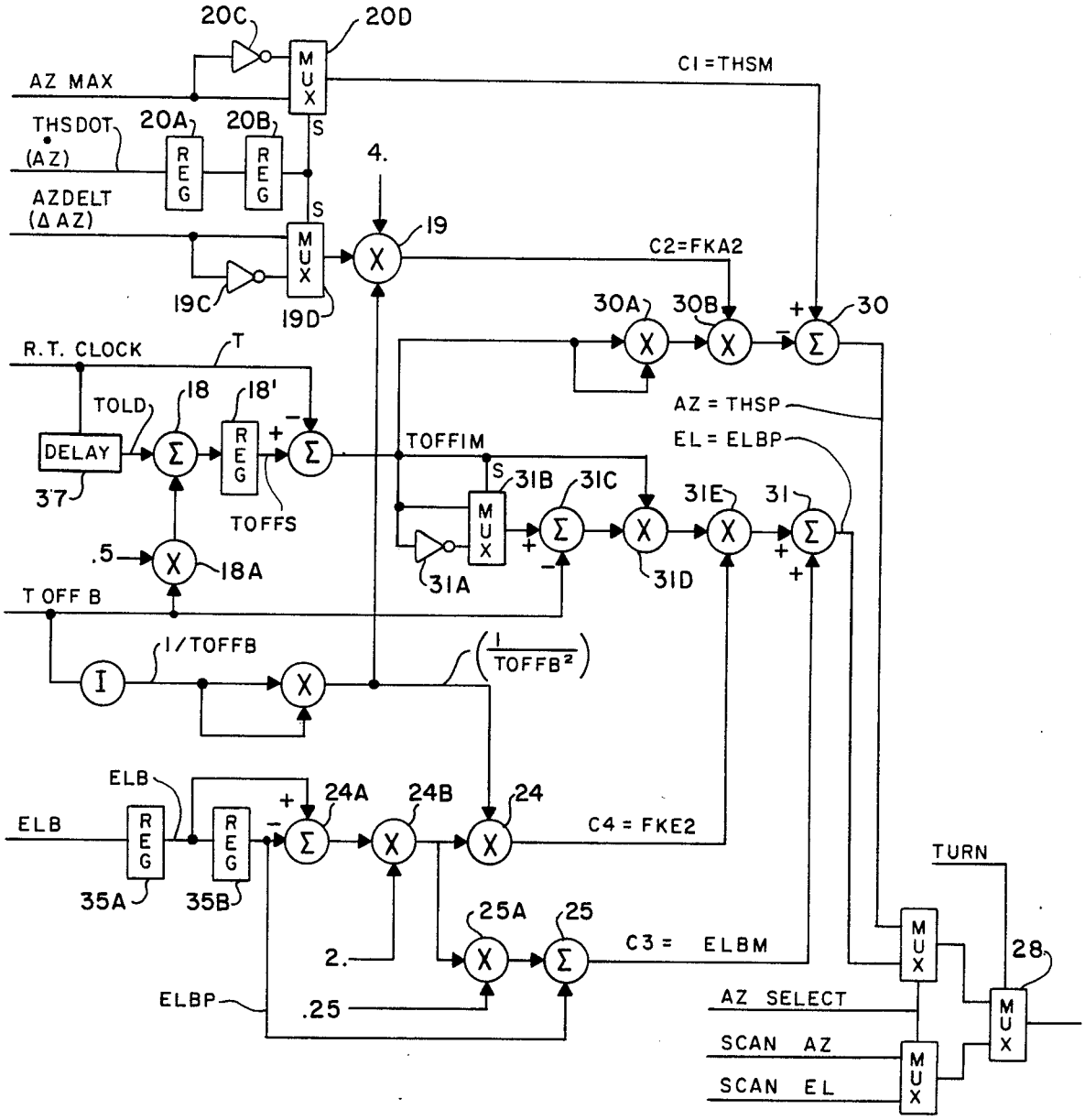
FIG. 1 is a symbolic functional block diagram of a programmable turnaround generator for mechanically scanned antennas.

One implementation of a programmable turnaround generator according to the invention is shown in FIG. 1. The implementation may be in hardware or software. In the hardware implementation of FIG. 1, the devices which are preferably digital include adders, multipliers, registers, a delay device, inverters, and multiplex units. The governing equations and inputs are shown from a FORTRAN simulation (See the program listing at the end of this description). Derivation of the equations is based on constant acceleration/deceleration. Several formulations of equations have been tried, with more or less success.

The following two equations are mechanized in the preferred embodiment to program the desired turn.

Note this special, simple formulation.

$$AZ_t = C_1 - C_2 \cdot (t')^2$$

$$EL_t = C_3 + C_4 \cdot t' \cdot (|t'| - C_5)$$

Where t' is a function of the real time (R.T.) clock and $C_1$ through $C_5$ are constants for a specific turn calculated from the desired turn time, excursion and scan bar positions, or could be preset values. These values and others are defined in the program listing, and are specifically as follows:

| | | |
|---|---|---|
| $C_1$ | THSM | Azimuth position at the middle of the turnaround. |
| $C_2$ | FKA2 | Multiplier for azimuth. |
| $C_3$ | ELBM | elevation position at the middle of the turnaround. |
| $C_4$ | FKE2 | Elevation multiplier. |
| $C_5$ | TOFFB | The desired time of offbar or turnaround time, e.g. 200 milliseconds. |
| | AZDELT | The maximum excursion beyond end of bar, e.g. |

-continued

| | |
|---|---|
| | if the bar is 20°. delta might be 2°. |
| ELB | Bar position in elevation, e.g. 3°or 4°. |
| ELBP | The commanded output value for the elevation $EL_t$. |
| KOFF | Bar counter for the test case (not part of normal implementation), part of the test driver. |
| SCWR | Scan width in radians - ½ of a bar pattern - e.g. for a ±30° bar pattern, SCWR = 30°. |
| THSDOT | Onbar scan rate, e.g. 60°/second. |
| THSP | The commanded output value for the azimuth $AZ_t$ |
| TOFFB2 | = TOFFB/2, one half of the turn time. |
| TOFFIM | Offset counter used in the calculation of AZ & EL position, e.g. +100 to −100 milliseconds. |
| TOFFS | Time at the middle of the turn period. |

The operation represented by the program listing and FIG. 1 are part of a larger system for controlling the radar which includes the antenna scanning. When a bar scan is required the operation shown here is entered at regular intervals, for example every 5 milliseconds. A real time clock controls a counter giving a current value of T. The system designates a scan width SCWR, a value equal to ½ the desired bar in azimuth. The system also determines values for the azimuth and elevation for beginning a scan. The value of the azimuth at the center of the desired scan is given a relative value of zero for use by this program, so that negative values designate left of center and positive values right of center.

The operation commences at line 12 of the program listing with a test to determine whether the absolute vaue of the last azimuth position is less than the scan width in radians. "Yes" indicates an onbar position, causing an on/offbar indicator IOFF to set to zero. Note that for a greater value of azimuth, IOFF may be either a zero or a one.

At line 13, the azimuth value test is repeated, and ORed with a test for IOFF equal to one. If either test gives a "yes", the operation goes to address 86 (line 27); and otherwise proceeds to the next line.

Lines 16–25 are the offbar initialization equations; and the operation is also illustrated by the apparatus in FIG. 1. At line 16 the indicator IOFF is set to the offbar value of one.

At line 17, the desired time of offbar or turnaround time is set to the desired value, in this case 200 milliseconds.

At line 18, the time at the middle of the turn period TOFFS is set equal to one half of the desired turn around time, (in the specific case giving 100 milliseconds) plus the previous clock time.

At line 19, the constant $C_2$, a multiplier for azimuth, is set. The quantity SIGN(AZDELT,THSDOT) is a FORTRAN intrinsic function. The first argument AZDELT provides the magnitude, and the second argument provides the sign. AZDELT is an input from the system of the value for the maximum excursion beyond the end of bar. THSDOT is also an input from the system of the value for the onbar scan rate. However its sign is changed by this program (at line 21) during each offbar initialization to reverse the direction of scan. The function operation is performed in FIG. 1 by a multiplex device 19D, which has one input AZDELT, and another input of the same magnitude but reversed in sign via device 19C. Which sign is chosen is determined by the selection input supplied from THSDOT via registers 20A and 20B. Registers 20A and 20B provide the required synchronization and delay to provide a previous value of THSDOT. A multiplier device 19 multiplies the output of multiplexer 19D by 4 and the quantity ($1/TOFFB^2$). This last quantity has the value 25 when TOFFB is 0.2 seconds, and multiplied by 4 equals 100.

At line 20, the constant $C_1$, the azimuth position at the middle of the turnaround, is set. The magnitude of the intrinsic function, SCWR+AZDELT, is the scan width rate plus the maximum excursion beyond the end of the bar. The argument giving the sign is the same as on line 19. The operation in FIG. 1 is performed by the devices 20C and 20D.

Line 22 provides a 4-bar counter, an optional feature which was used in the test embodiment. Usually the system would determine the scan pattern including the number of bars, and give a command for one bar and one turnaround at a time.

Line 23 uses the current value of the bar counter KOFF to determine the bar elevation ELB. DRC is the degree-to-radian conversion constant supplied from the system.

When *KOFF* = 0, *ELB* = 3.3 *DRC.*
1, 1.1 *DRC.*
2, −1.1 *DRC.*
3, −3.3 *DRC.*

At line 24, the constant $C_4$, a multiplier for elevation, is set. In FIG. 1, device 24A finds the difference between the elevation at the previous bar and the current elevation, and device 24B multiplies the result by 2. Device 24 multiplies this by ($1/TOFFB^2$).

At line 25, the constant $C_3$ is determined. In FIG. 1, the output of device 24B is divided by 4 in device 25A, and the current elevation ELBP is added thereto in device 25.

This completes the offbar initialization equations.

Line 27 (address 86) sets the offset counter used in the calculation of the azimuth and elevation position from +100 to −100 milliseconds. It is equal to the time at the middle of the turn period minus the current real time value. Note that the value of TOFFIM is zero at the center of a turn. It starts with a positive value and finishes with a negative value. TOFFB2 is calculated by TOFFB2=TOFFB/2. for the test.

Line 28 provides a test to determine whether to execute the turn equations or the onbar equations. If TOFFIM is less than −TOFFB2, the operation goes to address 87 (line 34) for the onbar equations, and otherwise proceeds to line 30 for the turn equations. This is shown in FIG. 1 by a multiplexer unit 28.

The turn equations executed at lines 30 and 31 are:

$$AZ_t = C_1 - C_2 \cdot (t')^2$$

$$EL_t = C_3 + C_4 \cdot t' \cdot (|t'| - C_5)$$

The onbar equations at lines 34 and 35 simply advance the azimuth position by an increment depending on the scan rate and the increment of time since the previous execution of the program. The elevation is set to a value which remains fixed during a bar.

After execution of either the turn equations or the onbar equations, the operation goes to address 88 (line 37) to provide output vectors. At line 37 the vaue of TOLD is set to the current time count. At lines 38–40 the vectors for controlling the antenna servos are set. Operation is then returned to the system.

The error signals for antenna pointing are generated electrically by the antenna servo system. Previous antenna controllers made no attempt to match commands to the natural mechanical response of the antenna (such as attempting to stop the antenna from starting onbar if a calibration was not complete). The result was that transients and phase delays were introduced in the error signals causing them to be useless to correct the commanded antenna vector to determine its true position accurately. The invention solves this problem by providing a dynamic programmed match between the antenna response and the system requirements. The result is that these electrically generated error signals now have sufficient quality to correct the commanded vector to determine true antenna position without the need for an addition of antenna pickoffs. This claim is demonstrated in FIG. 3.

A detailed simulation of the antenna servos for one system was employed to calibrate the results. The turnaround generator supplied a variety of turn command sequences to this simulation and the errors were plotted and tabulated. All features were exercised, including variable turn times, different excursion values and bar spacing, with excellent results. Although this turnaround generator can be used in a stand-alone manner, the range and flexibility of selecting turn parameters is increased when the output vector of the generator is further smoothed by the *Difference Vector Rate and Acceleration Controller* covered by a U.S. patent application Ser. No. 433,051, filed Oct. 5, 1982, assigned to Westinghouse Electric Corporation, now U.S. Pat. No. 4,463,297 issued July 31, 1984.

Figure 2:
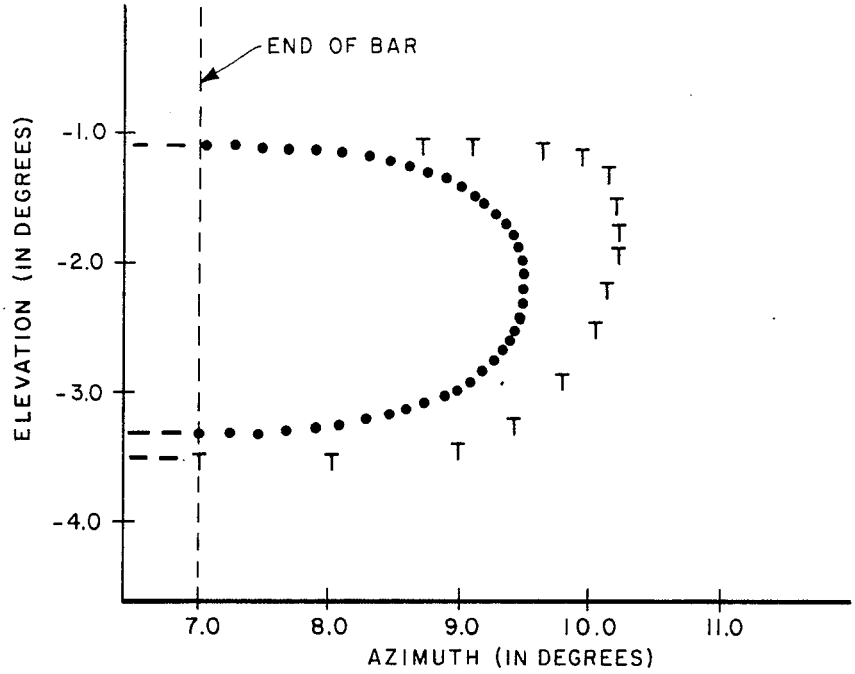
FIG. 2 is a graph showing computer simulation results for a typical antenna turnaround generated from closed form equations.

A typical 4-bar scan pattern was simulated and tested. The actual time history of the turnaround generator for a typical antenna turn around generated from closed form equations is plotted in FIG. 2, where the dots represent the actual commanded antenna position (5-millisecond steps). Selected true positions of the antenna, represented by the symbol T, are plotted also. The smooth behavior of the antenna results in accurate error signals which are used to correct the estimate of true position.

Figure 3:
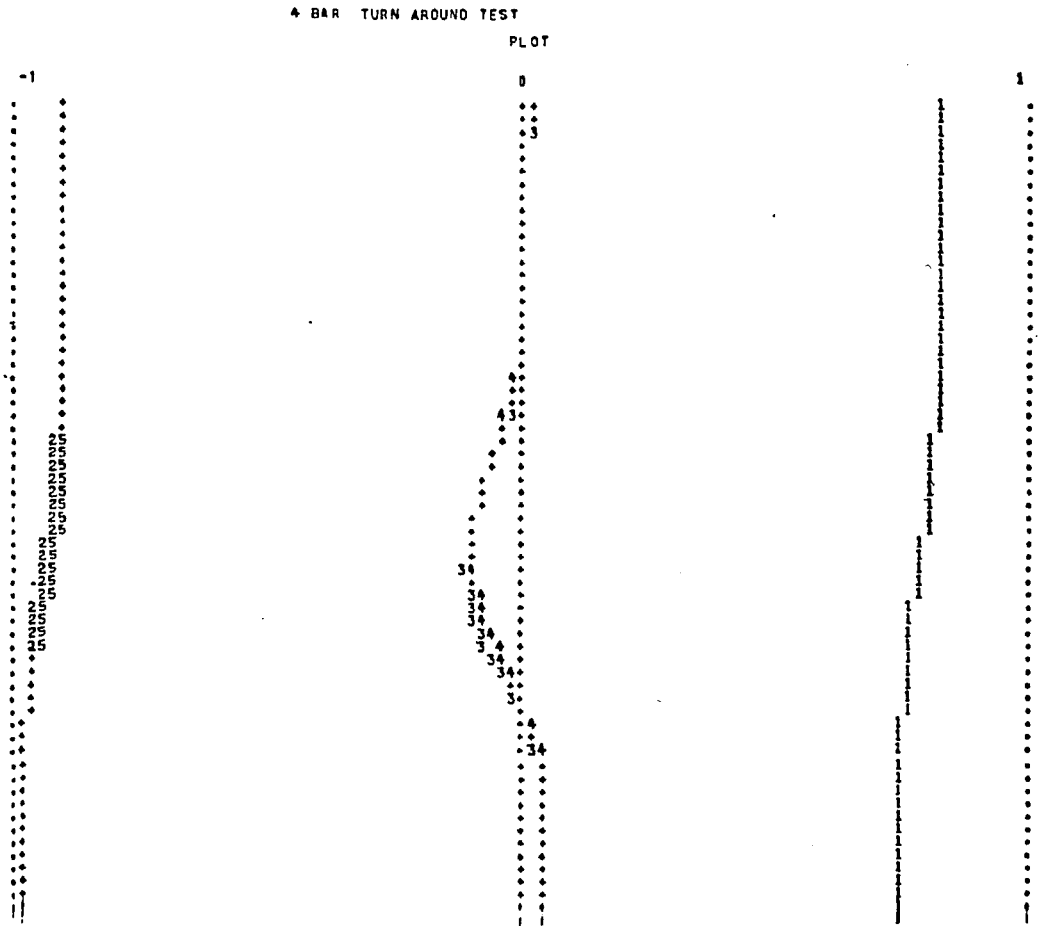
FIG. 3 is a plot of error signals for one turn.

FIG. 3 is a plot of the error signals for one turn. The plot has the format of a brush recorder, from top to bottom. The column headings "−1" and "1" are normalized values at the maximum negative and maximum positive values respectively, and "0" is the center column of interest. The "3" character represents the elevation channel error signal, the "4" represents the true error in elevation and + represents both. (The "1" character at the right, and the "2" and "5" characters at the left are not relevent in this description, but are left on the drawing for orientation). The result displayed in the center is very important in showing the improvement provided by the invention. It illustrates that the antenna servo generated error signals are now an accurate measure of the true error of antenna position from the commanded position, and can be used to calculate true antenna position.

The tabulated results show that during the entire turn period, the worst error in the corrected position vector was about 0.2 degree for AZ or EL, and even better results for onbar. This is an improvement by a factor of 2 or 3 in onbar from a previous production system having 0.5 to 0.7 degree error. The improvement factor in the turn period is even larger.

Figure 4:
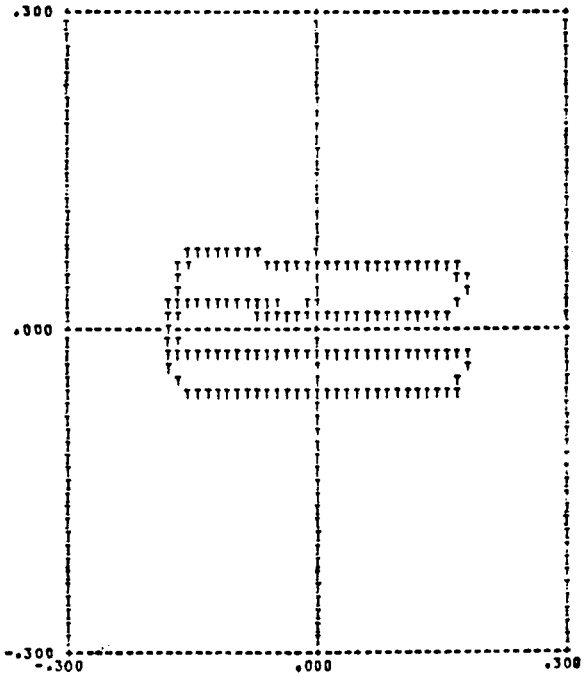
FIG. 4 is a line printer plot illustrating a typical 4-bar scan pattern.

FIG. 4 is a line printer plot (of obvious problems with quantization error) which is included for completeness to illustrate a typical 4-bar scan pattern.

It is understood that certain modifications to the invention as described may be made, as might occur to one with skill in the field of this invention, within the scope of the appended claims. Therefore, all embodiments contemplated hereunder which achieve the objects of the present invention have not been shown in complete detail. Other embodiments may be developed without departing from the spirit of the invention or from the scope of the appended claims.

FORTRAN PROGRAM
4-BAR TURN AROUND TEST

```
C
C
80  IF(ABS(THSP).LT.SCWR) IOFF=0
    IF(ABS(THSP).LT.SCWR.OR.IOFF.EQ.1) GO TO 86
C
C                    ** OFFBAR INITIALIZATION EQUATIONS **
    IOFF=1
    TOFFB=.2
    TOFFB2 = TOFFB/2.
    TOFFS=TOFFB/2.+TOLD
    FKA2=4. *SIGN(AZDELT,THSDOT)/TOFFB**2
    THSM=SIGN(SCWR+AZDELT,THSDOT)
    THSDOT=-THSDOT
    KOFF=MOD(KOFF+1,4)
    ELB=3.3*DRC-KOFF*2.2*DRC
    FKE2=2.*(ELB-ELBP)/TOFFB**2
    ELBM=ELBP+(FKE2*TOFFB**2)/4.
C
86  TOFFIM=TOFFS-T
    IF(TOFFIM.LT.-TOFFB2) GO TO 87
C                                   ** TURN EQUATIONS **
    THSP=THSM-FKA2*TOFFIM*TOFFIM
    ELBP=ELBM+FKE2*TOFFIM*(ABS(TOFFIM)-TOFFB)
    GO TO 88
C                                   ** ONBAR EQUATIONS **
87  THSP=THSP+THSDOT*(T-TOLD)
    ELBP=ELB
C                                   ** OUTPUT VECTOR **
88  TOLD=T
    VDES(1)=COS(THSP)*COS(ELBP)
    VDES(2)=SIN(THSP)*COS(ELBP)
    VDES(3)=SIN(ELBP)
```

I claim:

1. A programmed generator for a mechanically scanned antenna, to provide an n-bar scan pattern (n being a positive integer equal to one or greater), including a turnaround generator for controlling the antenna movement between bars, with predetermined inputs to the generator comprising a desired turnaround time, a maximum excursion of the antenna in azimuth, a start position for each bar, and on onbar scan rate;

wherein the turnaround generator comprises means to implement closed form equations which control both the position and the rate with constant acceleration, so that error signals indicate the actual movement of the antenna and its true error in the current commanded position;

wherein said closed form equations are $$AZ_t = C_1 - C_2 \cdot (t')^2$$

$$EL_t = C_3 + C_4 \cdot t' \cdot (|t'| - C_5)$$

where t' is a function of a real time clock, $C_1$ is the azimuth position at the middle of the turnaround, $C_2$ is a multiplier for azimuth, $C_3$ is the elevation position at the middle of the turnaround, $C_4$ is an elevation multiplier, and $C_5$ is the desired time of offbar or turnaround time.

2. The programmed generator according to claim 1, including means for implementing offbar initialization equations in which:

the turnaround time is set to said predetermined value:

an offset time indicator is equal to the time at the middle of the turn period minus the current real time value;

$C_2$ is set to a value whose magnitude is the maximum excursion beyond the end of the bar and whose sign depends on the current direction of scan, this quantity being multiplied by a constant and divided by the square of the turnaround time;

$C_1$ is set to a value whose magnitude is the sum of the scan width and the maximum excursion beyond the end of the bar and whose sign depends on the current direction of scan;

the direction of scan is reversed by changing the sign of the value for the scan rate;

$C_4$ is set to a value equal to two times the bar spacing in elevation divided by the square of the turnaround time; and $C_3$ is set to a value equal to the current elevation plus the quantity $C_4$ times the square of the turnaround time divided by four.

* * * * *